US007651080B2

(12) United States Patent
Kuechler et al.

(10) Patent No.: US 7,651,080 B2
(45) Date of Patent: Jan. 26, 2010

(54) GATHERER STITCHER HAVING A STITCHING STATION

(75) Inventors: Ralph Kuechler, Ehingen (DE); Thomas Gerlach, Tuttlingen (DE); Claus-Otto Hohner, Tuttlingen (DE)

(73) Assignee: Hohner Maschinenbau GmbH, Tuttlingen (DE)

( * ) Notice: Subject to any disclaimer, the term of this patent is extended or adjusted under 35 U.S.C. 154(b) by 130 days.

(21) Appl. No.: 11/076,283

(22) Filed: Mar. 10, 2005

(65) Prior Publication Data

US 2005/0206062 A1 Sep. 22, 2005

(30) Foreign Application Priority Data

Mar. 10, 2004 (DE) ..... 10 2004 011 973

(51) Int. Cl.
*B65H 37/04* (2006.01)

(52) U.S. Cl. ..... 270/52.29; 270/52.14; 270/52.26; 270/52.16

(58) Field of Classification Search ..... 270/52.14, 270/52.18, 52.26, 52.29
See application file for complete search history.

(56) References Cited

U.S. PATENT DOCUMENTS

| | | | | | |
|---|---|---|---|---|---|
| 1,287,334 | A | * | 12/1918 | Kast | 270/52.15 |
| 1,644,192 | A | * | 10/1927 | Kast | 270/52.15 |
| 4,260,145 | A | * | 4/1981 | Mebus et al. | 270/52.14 |
| 4,614,290 | A | * | 9/1986 | Boss | 227/1 |
| 4,711,440 | A | * | 12/1987 | Bulka et al. | 270/52.18 |
| 6,142,354 | A | * | 11/2000 | Boss et al. | 227/100 |
| 6,994,337 | B1 | * | 2/2006 | Cracknell et al. | 270/52.29 |
| 2003/0001327 | A1 | * | 1/2003 | Brunner et al. | 270/58.08 |

FOREIGN PATENT DOCUMENTS

| | | | |
|---|---|---|---|
| CH | 6 91 229 | A5 | 5/2001 |
| DE | 34 43 376 | C2 | 8/1985 |
| DE | 100 58 796 | A1 | 11/2001 |
| DE | 101 30 662 | A1 | 1/2003 |
| EP | 0 659 586 | B1 | 6/1995 |

* cited by examiner

*Primary Examiner*—Gene Crawford
*Assistant Examiner*—Leslie A Nicholson, III
(74) *Attorney, Agent, or Firm*—Breneman & Georges

(57) ABSTRACT

The invention provides a gatherer stitcher having at least one stitching station (1) for stitching sheets, the stitching station being arranged on a stitching carriage that can move in the longitudinal direction (X) of a gatherer chain during the stitching operation and at least one ejector unit being provided after the stitching station in the transport direction of the sheets in order to eject the sheets, to provide a gatherer stitcher exhibiting a higher operational reliability as compared with the prior art. According to the invention, this is achieved in that at least one acceleration and/or braking unit (4) for accelerating and/or braking the sheets in the longitudinal direction (X) toward the ejector unit is arranged between the stitching carriage and the ejector unit.

14 Claims, 2 Drawing Sheets

GATHERER STITCHER HAVING A STITCHING STATION

Figure 1:
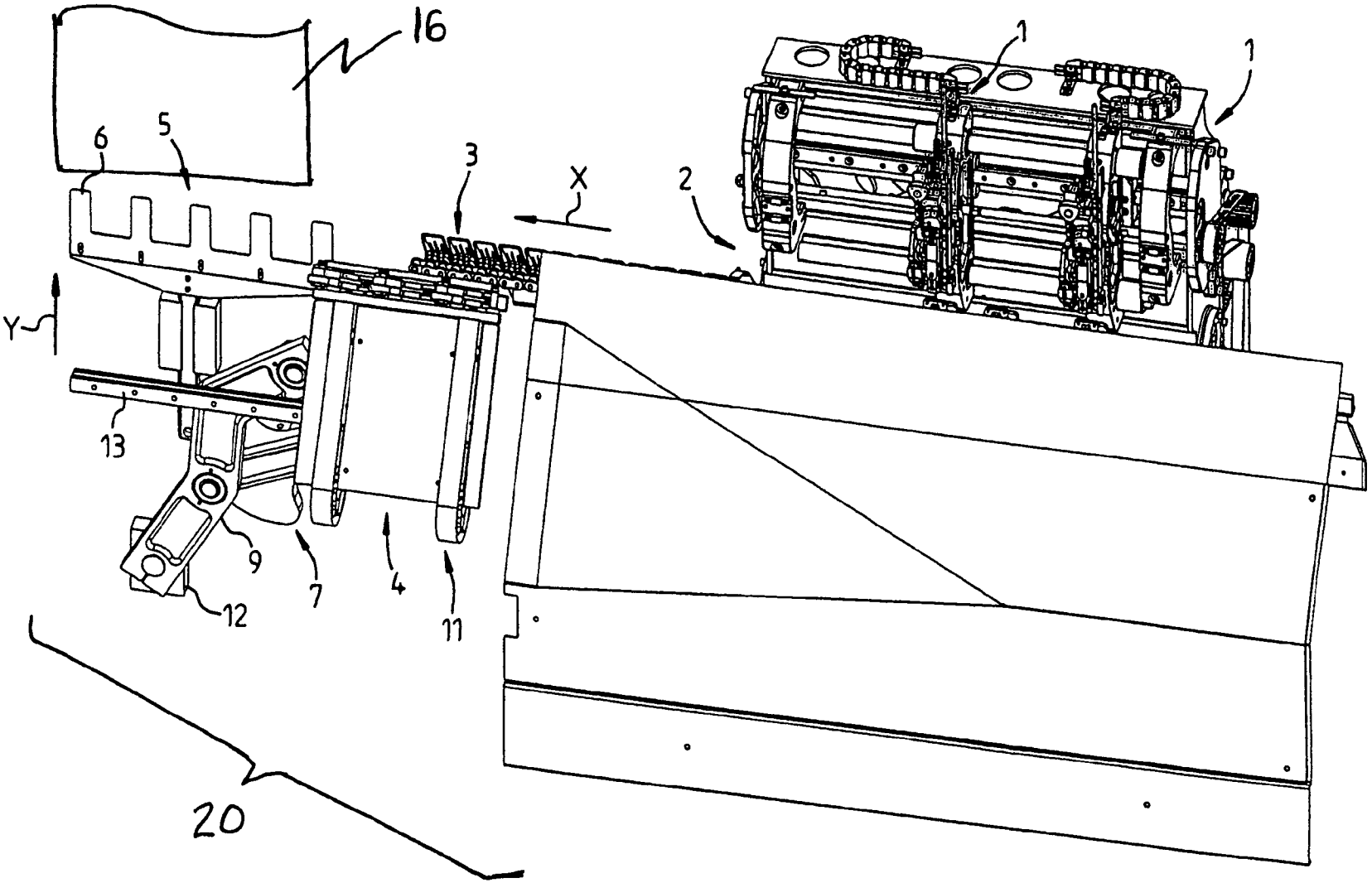

BACKGROUND OF THE INVENTION (1) Field of the Invention

The invention relates to a gatherer stitcher having at least one stitching station for stitching sheets, the stitching station being mounted on a stitching carriage that can move in the longitudinal direction of a gatherer chain during the stitching operation and at least one ejector unit being provided after the stitching station in a transport direction (X) of the sheets in order to eject the sheets. More particularly the invention pertains to an acceleration and/or braking unit disposed between the stitching carriage and the ejector unit.

(2) Description of Related Art Including Information Disclosed Under 37 CFR 1.97 and 1.98

Gatherer stitchers are generally paper-processing machines with which a product, for example a brochure, is assembled from a plurality of folded sheets and is stitched. Printed folded sheets from stacks, lying on folded sheet feeders or standing on the spine, are supplied in separated form, opened and placed on a gatherer chain. The number of folded sheets to be stitched is gathered and aligned on the gatherer chain by means of drivers. The gatherer chain transports the gathered folded sheets to a stitching device, where these are stitched with wire staples by means of stitching heads. Optionally, perforation of the products may be provided. In order to trim the edge of the stitched products, what is known as a trimmer (3-cutter) is normally provided after the ejector, from which the end products are transported onward to a delivery.

In gatherer stitchers, two stitching principles can expediently be employed: stitching at a standstill or stitching on the moving product. In order to perform stitching on the moving product, the stitching device, comprising stitching carriage and bending-over device or stitching station, has to be moved together with the product to be stitched and has to be coordinated with the movement of the latter, at least for some time.

The gatherer stitcher is often driven by a central electric motor. In this case, the various subassemblies, such as the stitching apparatus, the gatherer chain, the folded sheet feeder, the ejector, the trimmer and possibly further components are driven by various gear mechanisms and a common shaft, what is known as a king shaft.

The gatherer chain has a comparatively high transport speed, so that up to several booklets are produced per second. Because of this high transport speed of the sheets or booklets, it is possible for markings or scratching/rubbing tracks on the booklets and/or for tilting of the booklets to occur as a result of the deflection of the direction of movement of the booklets by means of the ejector. This leads, inter alia, to damage or impairment to the quality of the booklets produced.

It is precisely because of the aforementioned high transport speeds that even short stoppages of the gatherer stitcher lead to a considerable reduction in the booklets produced, on account of the faults described above. Furthermore, a relatively high overrun or backup with booklets wedged or jammed in one another is produced relatively quickly and in general can be eliminated only with a considerably great effort on repair.

BRIEF SUMMARY OF THE INVENTION

It is an object of the invention to provide a gatherer stitcher having at least one stitching station for stitching sheets, the stitching station being arranged on a stitching carriage that can move in the longitudinal direction of a gatherer chain during the stitching operation and at least one ejector unit being provided after the stitching station in the transport direction of the sheets in order to eject the sheets, said gatherer stitcher exhibiting a higher operational reliability as compared with the prior art.

On the basis of a gatherer stitcher of the type mentioned at the beginning, this object is achieved by at least one acceleration and/or braking unit for accelerating and/or braking sheets in a longitudinal direction (X) toward an ejector unit disposed between a stitching carriage and the ejector unit.

Advantageous embodiments and applications of the invention are possible as a result of having the acceleration and/or braking unit first accelerate and then subsequently brake the sheets, having at least one carrier for driving the sheets, having at least one clamping unit for clamping the sheets, having a clamping unit with at least two clamping finger elements and a clamping bar, having a crank drive for the acceleration and/or braking unit, having an ejector direction (Y) of the sheets in the region of the ejector unit substantially perpendicular to the transport direction (X) of the sheets in the region of the gatherer chain, having a lifting element for lifting the sheets and a belt apparatus for moving the sheets onward and having an ejector unit with a lifting device for lifting the braked sheets.

Accordingly, a gatherer stitcher according to the invention is characterized by the fact that at least one acceleration and/or braking unit for accelerating and/or braking the sheets in the longitudinal direction toward the ejector unit is arranged between the stitching carriage and ejector unit. With the aid of this measure, it is possible in an elegant manner to implement an advantageous influence on or change in the transport speed of the sheets. In this way, the transport direction can advantageously be changed, in particular it can be decreased, in such a way that a deflection of the sheets, which follows or takes place thereafter in the transport direction, can be implemented with the aid of the ejector without impairing the sheets or the gatherer stitcher operation.

The accelerating and/or braking unit is advantageously designed first to accelerate and then subsequently to brake the sheets. As a result of the chronologically preceding acceleration of the sheets, it is possible to generate a gain in time with respect to the transport speed of the gatherer chain, so that braking the sheets, in particular down to a standstill, can be implemented without any overrun. This means that the average speed of the sheets in the region of the acceleration and/or braking unit is preferably not changed or reduced, or only comparatively little, as compared with the transport speed of the sheets on the gatherer chain.

Precisely by means of the advantageous braking at the end of this process step, it is ensured that disadvantageous markings or tracks/scratches on the sheets and/or tilting of the sheets as a result of the deflection of the transport direction of the sheets with the aid of the ejector are effectively prevented.

In an advantageous variant of the invention, the acceleration and/or braking unit comprises at least one driver apparatus for driving the sheets. By means of the driver apparatus, the gatherer chain in the region of the acceleration and braking unit can be dispensed with, which reduces the outlay on construction of the gatherer stitcher and also improves the handling of the gatherer chain.

The driver apparatus preferably has at least one clamping unit for clamping the sheets. The fact that the clamping unit is arranged after the stitching station means that slipping of the individual sheets can no longer take place in this case. The clamping unit advantageously prevents any relative movement between sheet and clamping unit, so that markings on or impairments of the sheets do not arise.

In a particular development of the invention, the sheets can be clamped by at least two clamping finger elements and a clamping bar. Appropriate clamping fingers can be implemented particularly simply and, together with the clamping bar, ensure secure clamping and releasing of the clamping.

The acceleration and/or braking unit advantageously has a crank drive. With the aid of a crank drive according to the invention, the linear movement of the driver apparatus or clamping unit can advantageously be produced by a rotational movement, in particular with the aid of an electric motor or the like.

In a preferred embodiment of the invention, the ejection direction of the sheets in the region of the ejector unit is substantially perpendicular to the transport direction of the sheets in the region of the gatherer chain. In this way, in particular tilting of the booklets in the region of the ejector is effectively prevented, since the sheets are moved substantially at right angles to the fold and preferably along the transport direction of the ejector or along the units adjacent to the latter. This measure leads to a further increase in the operational reliability of the gatherer stitcher. Furthermore, transverse displacement or the like of the sheets or brochures with respect to corresponding machine parts is hereby prevented in an elegant manner, so that markings, such as tracks or scratches, are not produced on the sheets or brochures.

The ejector unit preferably has a lifting element for lifting the sheets and a belt apparatus for moving the sheets onward. A lifting element according to the invention engages in the fold of the sheets, for example, and lifts the latter substantially in the vertical direction away from a guide rail or the like or upward. In this case, the sheets are gripped by the advantageous belt apparatus and, in particular, supplied to the trimmer or the cutting unit.

In an advantageous variant of invention, the ejector unit lifts the braked sheets. In the chronological sequence of the gatherer stitcher according to the invention, the sheets are gathered, stitched, gripped by the acceleration and/or braking unit, these being braked in particular and then, in the braked state, in particular at a standstill, being gripped and lifted by the ejector unit and the lifting element. This advantageous chronological sequence increases the operational reliability of the gatherer stitcher according to the invention in a decisive manner, since appropriately braked or stopped sheets can be deflected and/or and lifted without disruption and supplied to the cutting unit. In general, it is advantageous to provide a deflection of the sheets, that is to say a considerable and relevant change in the transport direction of the sheets, in the braked state or with the sheets at a standstill.

BRIEF DESCRIPTION OF THE SEVERAL VIEWS OF THE DRAWING(S)

Figure 2:
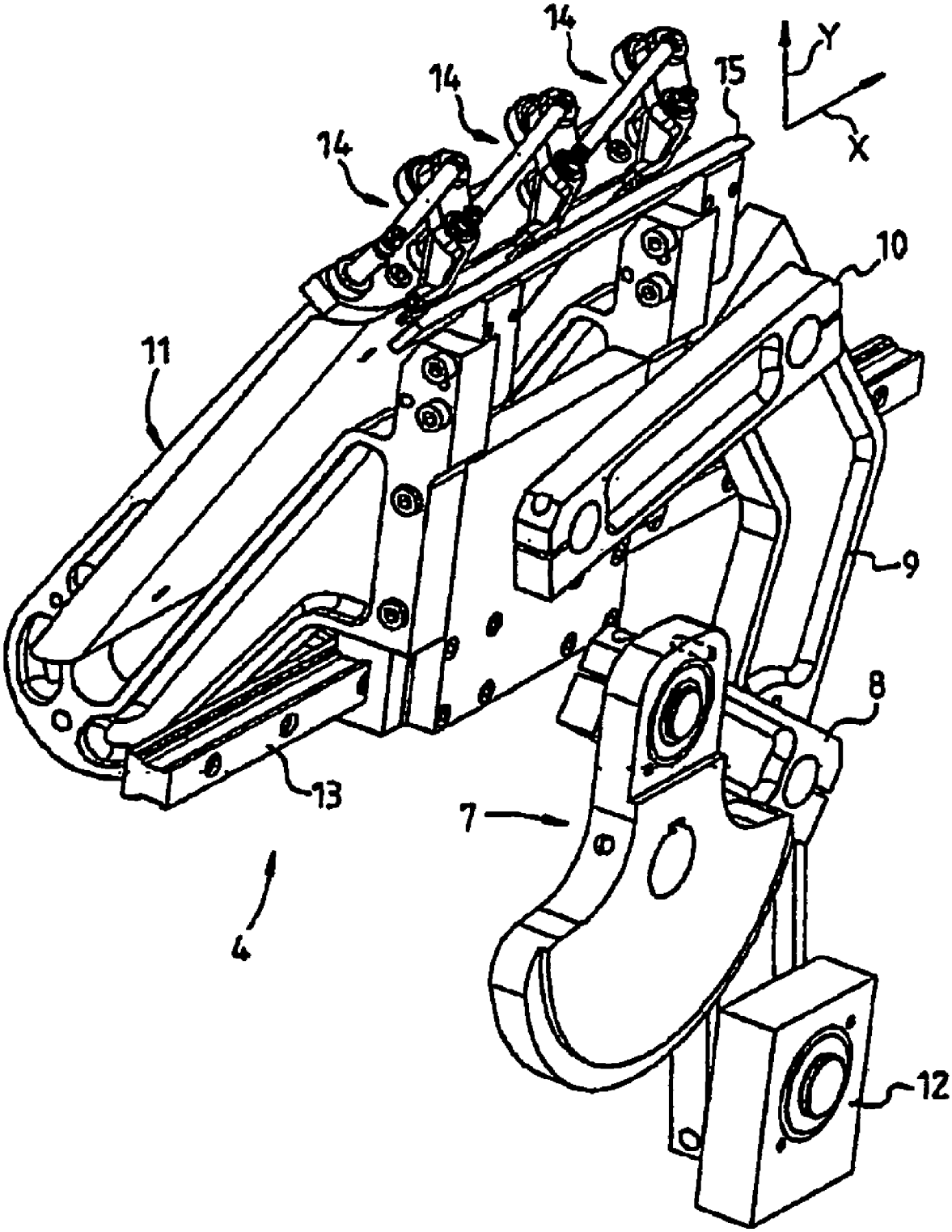

An exemplary embodiment of the invention is illustrated in the drawing and will be explained in more detail in the following text by using figures, in which, in detail:

FIG. 1 shows a schematic, perspective illustration of a detail of a gatherer stitcher according to the invention and FIG. 2 shows a schematic, perspective illustration of an acceleration and/or braking unit according to the invention.

DETAILED DESCRIPTION OF THE SEVERAL VIEWS OF THE INVENTION INCLUDING BEST MODE

FIG. 1 illustrates a detail of a gatherer stitcher. The gatherer stitcher 20 comprises two stitching stations 1, which are arranged such that they can be moved along a gatherer chain 3 on a stitching carriage 2 during the stitching operation.

Although not specifically illustrated, individual folded sheets are gathered before the stitching stations 1 in a known manner and are supplied to the latter 1 by means of a gatherer chain 3.

The gatherer chain 3 transfers the stitched sheets to a braking unit 4 and the latter in turn transfers the sheets to an ejector 5. The ejector 5 lifts the sheets substantially at right angles to the transport direction of the sheets of the gatherer chain 3 in the region of the braking unit 4. Here, according to the invention, a sheet is lifted by the ejector 5 or by the lifting comb 6 of the latter while at a standstill to the greatest possible extent and is supplied by belt apparatus 16 to a trimmer or a cutting unit, not specifically illustrated.

The braking unit 4 is illustrated in more detail in FIG. 2. The braking unit 4 is driven with the aid of a crank mechanism 7. The crank mechanism 7 drives a carriage 11 by means of a connecting rod 8, a swinging arm 9 and a pulling and pushing arm 10. In this case, the swinging arm 9 is mounted securely and in a fixed position by means of a bearing 12 with a fixed pivot. The pulling and pushing arm imparts a non harmonic motion or a non uniform movement in the speed of the sheets in the acceleration and/or braking unit in which the speed of the sheets is changed by speeding up or slowing down the sheets only comparatively little.

The carriage 11 moves in the longitudinal direction of the gatherer chain 3 and along a rail 13 which, at the same time, guides the carriage 11 and forms the linear guide. In this variant of the invention, the carriage 11 has three clamping fingers 14 and a clamping bar 15, which grip and clamp the sheets, not specifically illustrated, in the direction X in the front region of the rail, then accelerate them longitudinally in the direction X and, in the rear region of the rail 13, brake the sheets, in particular down to a standstill. The sheets are then lifted in the direction Y by the comb 5 and supplied to a cutting apparatus.

The nub of the invention is the change in the direction and speed of the sheets after the stitching carriage in a gatherer stitcher having at least one acceleration and/or braking unit 4 for accelerating and/or braking the sheets from the longitudinal direction X into the direction Y aligned substantially at right angles thereto with the aid of the braking unit 4, which brakes the sheets to a great extent or down to a standstill for the ejector 5. This ensures fault-free operation of the gatherer stitcher according to the invention. Furthermore, disadvantageous markings or tracks on the sheets to be processed are effectively prevented. This leads to an improvement in the quality of the sheets.

LIST OF DESIGNATIONS

1. Stitching station
2 Stitching carriage
3 Gatherer chain
4 Acceleration and/or Braking unit
5 Ejector
6 Comb
7 Crank mechanism
8 Connecting rod
9 Swinging arm
10 Pulling/pushing arm
11 Carriage
12 Bearing
13 Rail
14 Clamping finger
15 Clamping bar

16 Belt apparatus
X Direction
Y Direction
20 Gatherer stitcher

What is claimed is:

1. A gatherer stitcher having at least one stitching station (1) for stitching sheets, the stitching station (1) being arranged on a stitching carriage (2) that can move back and forth in the longitudinal direction with a gatherer chain (3) during the stitching operation and an ejector unit (5) disposed after the stitching station (1) in the transport direction (X) of the sheets to eject the sheets, wherein the improvement comprises at least one acceleration and braking unit (4) disposed between the stitching carriage (2) and the ejector unit for accelerating and/or braking the sheets to prevent a tilting or overrun of the sheets by first accelerating the sheets to generate a gain in time before braking the sheets to maintain an average speed of the sheets with respect to a transport speed of subsequent sheets on the gatherer chain before changing the direction of the sheets from the longitudinal transport direction (X) to the perpendicular direction (Y) toward the ejector unit (5) said ejector unit having a means for lifting said sheets substantially perpendicular to the transport direction (X) and a clamping unit (14, 15) for clamping said sheets just before said sheets are lifted in a direction substantially, perpendicular to said transport direction (X).

2. The gatherer stitcher as claimed in claim 1 wherein the clamping unit (14, 15) comprises at least two clamping finger elements (14) and a clamping bar (15).

3. The gatherer stitcher as claimed in claim 1, wherein the acceleration and braking unit (4) has a pushing and pulling arm for accelerating said sheets and braking said sheets.

4. The gatherer stitcher as claimed in claim 1 or 3 wherein the acceleration and braking unit (4) further comprises at least one carrier (14, 15) for driving the sheets.

5. The gatherer stitcher as claimed in claim 1 or 3 wherein the acceleration and braking unit (4) has a crank drive (7).

6. The gatherer stitcher as claimed in claim 1 or 3 wherein the ejector direction (Y) of the sheets in the region of the ejector unit (5) is substantially perpendicular to the transport direction (X) of the sheets in the region of the gatherer chain (3).

7. The gatherer stitcher as claimed in claim 1 or 3 wherein the ejector unit (5) has a lifting element (6) for lifting the sheets and a belt apparatus for moving the sheets onward.

8. The gatherer stitcher as claimed in claim 1 or 3 wherein the ejector unit (5) lifts the braked sheets.

9. An Apparatus for paper processing machines having a stitching station disposed on a stitching carriage moveable back and forth in a longitudinal direction (X) of a gatherer chain during the stitching operation and an ejector unit disposed after the stitching station wherein the improvement comprises an acceleration and/or braking unit (4) disposed between said stitching carriage (2) and the ejector unit (5) for accelerating and/or braking the sheets to prevent tilting or overrun of the sheets by having a swinging arm (9) and a pulling and pushing arm (10) to first accelerate the sheets to generate a gain in time before braking the sheets to maintain an average speed of the sheets with respect to a transport speed of subsequent sheets on the gatherer chain before moving the sheets between the longitudinal direction (X) and a perpendicular direction (Y) for said ejector unit having a means for lifting the sheets.

10. The apparatus of claim 9 further comprising a clamping unit.

11. The apparatus of claim 10 wherein said clamping unit includes a clamping finger element.

12. The apparatus of claim 11 wherein said clamping unit includes a clamping bar.

13. A device for stitching sheets comprising:

(a) a stitching station disposed on a stitching carriage moveable back and forth in a longitudinal direction with said stitching carriage;

(b) an ejector unit disposed at one end of said stitching station having a means for lifting said sheets at substantially a right angle to said longitudinal direction;

(c) an acceleration and braking unit disposed between said stitching station and said ejector unit for accelerating and/or braking said sheets to prevent the tilting or overrun of sheets by a change in the transport speed of the sheets by having a swinging arm and a pulling and pushing arm to first accelerate the sheets to generate a gain in time before braking the sheets to maintain an average speed of the sheets with respect to a transport speed of subsequent sheets on the gatherer chain before changing the direction of the sheets from the longitudinal direction into a direction substantially at a right angle to the longitudinal direction; and (d) a clamping unit for clamping said sheets disposed between said ejector unit and said acceleration and braking unit.

14. The device of claim 13 further comprising a crank drive for said acceleration and braking unit.

* * * * *